US007168873B2

(12) United States Patent
Shawan et al.

(10) Patent No.: US 7,168,873 B2
(45) Date of Patent: Jan. 30, 2007

(54) LOTION APPLICATION APPARATUS

(75) Inventors: Anthony J. Shawan, Parma, OH (US); Isador H. Lieberman, Pepper Pike, OH (US)

(73) Assignee: Inventia Product Development LLC, Pepper Pike, OH (US)

( * ) Notice: Subject to any disclaimer, the term of this patent is extended or adjusted under 35 U.S.C. 154(b) by 282 days.

(21) Appl. No.: 10/821,079

(22) Filed: Apr. 8, 2004

(65) Prior Publication Data

US 2004/0208683 A1 Oct. 21, 2004

Related U.S. Application Data

(60) Provisional application No. 60/464,246, filed on Apr. 21, 2003.

(51) Int. Cl.

| | |
|---|---|
| ***A46B 5/02*** | (2006.01) |
| ***A46B 11/02*** | (2006.01) |
| ***B05C 17/00*** | (2006.01) |
| ***B43M 11/06*** | (2006.01) |
| ***A61H 15/00*** | (2006.01) |

(52) U.S. Cl. ..... 401/6; 401/28; 401/183; 401/208; 601/113; 601/129

(58) Field of Classification Search ..... 401/6, 401/208, 209, 219, 220, 216, 28, 8, 183–186; 15/110; 601/113, 120, 129, 112, 118, 119
See application file for complete search history.

(56) References Cited

U.S. PATENT DOCUMENTS

| | | | | |
|---|---|---|---|---|
| 3,870,419 | A * | 3/1975 | Sage | 401/8 |
| 3,959,841 | A * | 6/1976 | Horne | 15/104.94 |
| 4,896,984 | A | 1/1990 | Evans | |
| 5,088,849 | A | 2/1992 | Johnson et al. | |
| 5,125,757 | A * | 6/1992 | Morrison et al. | 401/21 |
| 5,131,384 | A * | 7/1992 | Obagi | 601/131 |
| 5,240,339 | A | 8/1993 | DeForest et al. | |
| 5,341,538 | A | 8/1994 | Banome | |
| D351,483 | S | 10/1994 | Angeletta | |
| D352,130 | S | 11/1994 | Zierhut | |
| 5,360,111 | A | 11/1994 | Arispe | |
| 5,388,700 | A | 2/1995 | Per-Lee | |
| D366,727 | S | 1/1996 | Possmann | |
| 5,545,456 | A * | 8/1996 | Suida | 428/76 |
| 5,564,851 | A | 10/1996 | Connelly et al. | |
| 5,568,669 | A | 10/1996 | Godown | |
| D375,382 | S | 11/1996 | Beeler et al. | |
| 5,615,962 | A | 4/1997 | Staub | |
| 5,823,206 | A | 10/1998 | Mapleback | |
| D414,295 | S | 9/1999 | Coleman | |
| 5,979,006 | A | 11/1999 | Stokes et al. | |
| 6,017,162 | A | 1/2000 | Call | |
| 6,042,286 | A | 3/2000 | Pazienza | |
| 6,045,279 | A | 4/2000 | Follis | |

(Continued)

*Primary Examiner*—David J. Walczak
(74) *Attorney, Agent, or Firm*—Tarolli, Sundheim, Covell, & Tummino LLP

(57) ABSTRACT

An apparatus for use in applying lotion to a portion of a body of an individual includes first and second handles which are connected with a lotion dispensing section. The lotion dispensing section includes a reservoir which holds a supply of lotion and a plurality of rollers. Each of the rollers has an inner portion exposed to the lotion in the reservoir and an outer portion which is engageable with the body of the individual using the apparatus.

16 Claims, 5 Drawing Sheets

U.S. PATENT DOCUMENTS

| | | | |
|---|---|---|---|
| D426,916 | S | 6/2000 | Ebert |
| 6,129,469 | A | 10/2000 | Messer et al. |
| 6,244,776 | B1 | 6/2001 | Wiley |
| 6,247,862 | B1 | 6/2001 | Garza |
| 6,261,014 | B1 | 7/2001 | Altobellis et al. |
| 6,412,997 | B2 | 7/2002 | Berke et al. |
| 6,438,787 | B1 | 8/2002 | Young |

* cited by examiner

LOTION APPLICATION APPARATUS

RELATED APPLICATION

This application claims priority from U.S. Provisional Patent Application Ser. No. 60/464,246, filed on Apr. 21, 2003, the subject matter of which is incorporated herein by reference.

FIELD OF THE INVENTION

The present invention relates to an apparatus for use in applying lotion.

BACKGROUND OF THE INVENTION

Portions of a back and other parts of a body of an individual may be difficult for the individual to manually reach. Therefore, the application of lotion to these portions of the individual is relatively difficult. It has been suggested that a device may be utilized to assist in the application of lotion to an individual. Patents disclosing devices for applying lotion include U.S. Pat. Nos. 5,564,851; 6,017,162; 6,244,776; 6,247,862; and 6,261,014.

SUMMARY OF THE INVENTION

The present invention provides a new and improved apparatus for applying lotion to portions of an individual's body. The apparatus includes a pair of handles which are connected with end portions of a lotion dispensing section. The lotion dispensing section includes a reservoir to hold lotion and a plurality of rollers. Each of the rollers has an inner portion exposed to the lotion in the reservoir and an outer portion which is engageable with the individual using the apparatus. The handles are movable by the individual using the apparatus to roll the rollers along the individual's skin.

The present invention includes a plurality of different features. These features may be used separately or in combination with each other. Features of the prior art may be used in combination with one or more of the features of the present invention.

BRIEF DESCRIPTION OF THE DRAWINGS

The foregoing and other features of the present invention will become more apparent upon a consideration of the following description taken in connection with the accompanying drawings wherein.

DESCRIPTION OF EMBODIMENTS OF THE INVENTION

Figure 1:
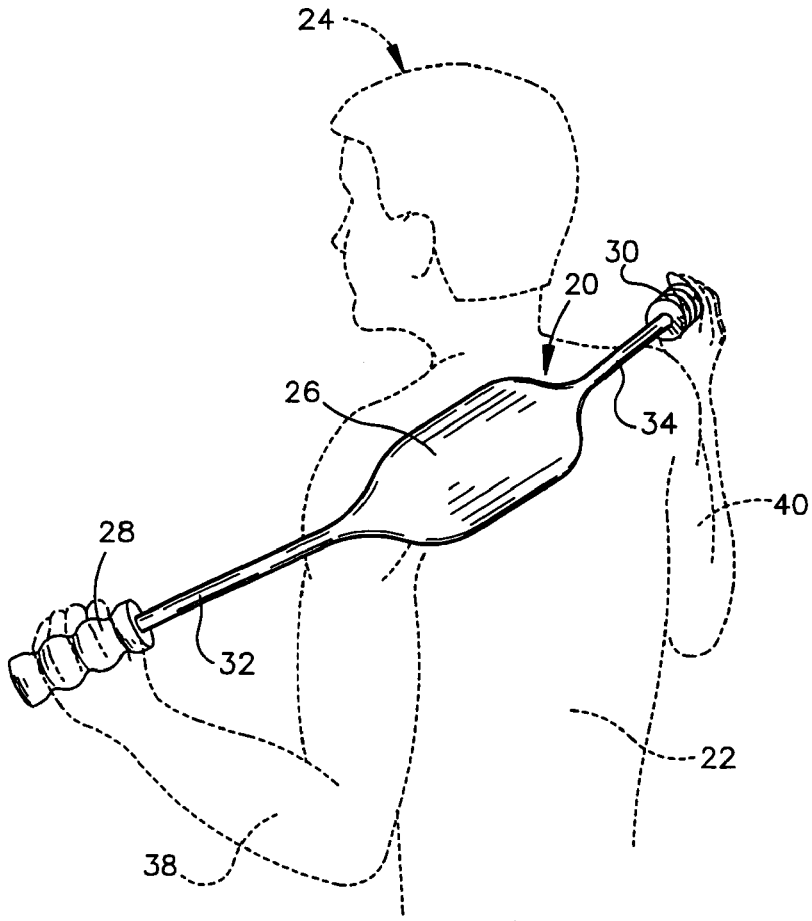
FIG. 1 is a schematic pictorial illustration depicting the manner in which a lotion application apparatus constructed in accordance with the present invention may be utilized to apply lotion to an individual.

A lotion application apparatus 20 (FIG. 1) is utilized to apply lotion to an individual. The apparatus 20 is particularly well adapted to apply lotion to at least a portion of a back 22 of an individual 24 using the lotion application apparatus. However, the apparatus 20 may be used to apply lotion to any desired portion of an individual's body. For example, the apparatus may be used to apply lotion to an individual's feet.

The lotion applied to the back 22 of the individual 24 with the lotion application apparatus 20 may be a liquid having medicinal, cosmetic, and/or cleansing properties. For example, the lotion application apparatus 20 may be utilized to apply sun tan lotion or a moisturizing lotion to a back 22 or other portion of an individual's body. The characteristics of the lotion will depend upon the desires of the individual 24 using the apparatus 20.

The lotion application apparatus 20 includes a dispensing section 26 (FIGS. 2 and 3) which is connected with a pair of handles 28 and 30 by connector sections 32 and 34. The individual 24 (FIG. 1) utilizing the lotion application apparatus 22 manually grips the handles 28 and 30. The individual's arms 38 and 40 are moved toward and away from opposite sides of the body to reciprocate the dispensing section 26 of the lotion application apparatus 20 along a path extending between left and right sides of the individual's body. At the same time, the dispensing section 26 may be moved vertically. This results in the dispensing section 24 being moved from side-to-side and up and down along the individual's back 22 to apply lotion to the individual's back. As previously mentioned, the apparatus 20 may be used to apply lotion to a portion of an individual's body other than the back 22. It is contemplated that the dispensing section 26 could be made so that it is removable from the handles 28 and 30 and moved over an individual's body by grasping the dispensing section.

The dispensing section 26 of the lotion application apparatus 20 includes a reservoir 44 (FIG. 3) which holds lotion 46. The reservoir 44 is filled with the lotion 46 through an inlet 48. The inlet 48 is closed by a removable cover 50.

In accordance with one of the features of the present invention, a plurality of rollers 54 (FIGS. 2 and 3) are rotatably mounted at lotion outlets from the dispensing section 26. The rollers 54 have inner portions 58 (FIGS. 3 and 4) which are exposed to the lotion 46 in the reservoir 44. The rollers 54 have outer portions 60 which are engageable with skin on the body of the individual 24 using the lotion application apparatus 20.

The illustrated rollers 54 have a spherical configuration. The spherical configuration of the rollers 54 enables them to move freely in any direction along the skin on the individual 24 using the lotion application apparatus 20. Thus, the rollers 54 can be moved from side-to-side and/or up and down along the skin on the individual 24. However, it is contemplated that the rollers 54 may have a different configuration if desired. For example, the rollers 54 may have a cylindrical configuration.

When the dispensing section 26 is moved along the back 22 of an individual 24, the outer portions 60 of the rollers 54 roll along the skin on the back of the individual. Rotation of the rollers 54 results in lotion being transferred from the reservoir 44 to the skin on the individual's back. The rollers 54 are effective to apply a thin, uniform coating of lotion to the skin on the individual's back 22.

The rollers 54 are provided with a plurality of circular grooves 66 which extend around the rollers 54 and conduct lotion 46 from the reservoir 44 to the skin on the individual's back 22. In addition, a thin film of lubricant is transferred from the outer portion 60 of the rollers 54 to the skin on the individual's back 22. During use of the lotion application apparatus 20, lotion 46 is transferred at a controlled rate from the reservoir 44 to the individual's back 22 by the grooves 66 and by a thin film of lotion on the outer portion 60 of the rollers.

In the illustrated embodiment of the invention, the grooves 66 have a circular configuration. However, it is contemplated that the grooves 66 could have a different configuration. For example, if the rollers 54 have a cylindrical configuration, the grooves 66 may have a helical configuration and be disposed in a coaxial relationship with the rollers.

The rollers 54 are disposed in sockets 72 (FIG. 4) formed in the dispensing section 26 (FIG. 3) of the lotion application apparatus 20. The dispensing section 26 of the lotion application apparatus 20 has a front panel or wall 74 in which the sockets 72 are formed. The sockets 72 have a configuration which corresponds to a portion of the spherical configuration of the rollers 54. Thus, the socket 72 has an inner side surface 78 (FIG. 4) with a configuration which corresponds to the configuration of a portion of sphere.

The inner side surface 78 of the socket 72 has a center of curvature which is coincident with the center of the spherical roller 54. The radius of the inner side surface 78 of the socket 72 is slightly greater than the radius of the roller 54. This enables a thin film of lotion 46 to move from the reservoir 44 through the socket 72 during rotation of the roller 54.

When an individual 24 is to utilize the lotion application apparatus 20 to apply lotion to his or her back 22, the individual grips the handles 28 and 30. The dispensing section 26 of the lotion application apparatus 20 is positioned with the rollers 54 engaging the skin on the individual's back 22. The handles 28 and 30 are manually pulled toward the front of the individual's body to press the rollers 54 against the individual's back.

The handles 28 and 30 are then reciprocated back and forth to move the rollers 54 between opposite sides of the individual's back 22. As this is done, the handles 28 and 30 are moved up and down to move the rollers 54 up and down along the individual's back 22. Of course, the apparatus 40 may be used to apply lotion to a portion of an individual's body other than the back 22.

Figure 4:
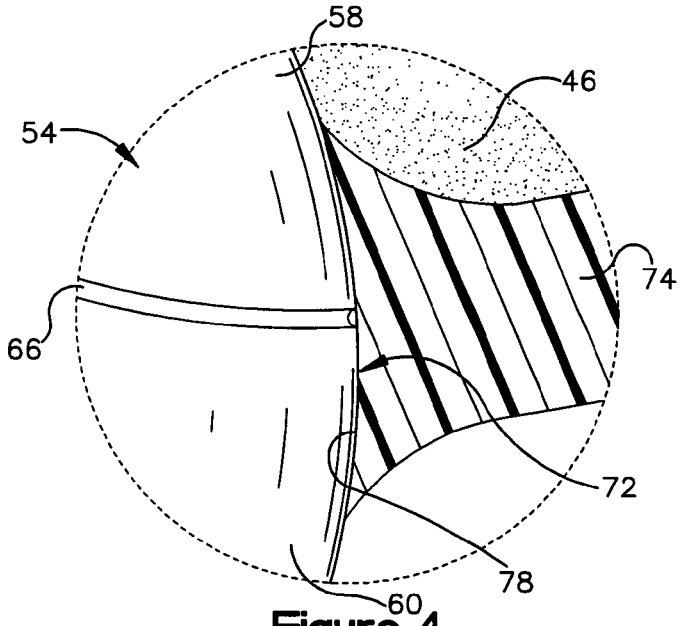
FIG. 4 is an enlarged fragmentary view illustrating the manner in which a roller cooperates with a socket formed in the front panel to conduct lotion from the reservoir during use of the lotion application apparatus.

During use of the lotion application apparatus 20, the lotion 46 in a reservoir 44 (FIG. 4) is pressurized. Pressurizing the lotion 46 in the reservoir 44 promotes an even flow of the lotion from the reservoir through a relatively small space between the roller 54 and the inner side surface 78 of the socket 72 (FIG. 4). The lotion 46 in the reservoir 44 is pressurized under the influence of force transmitted from the handles 28 and 30 through the connector sections 32 and 34 to the dispensing section 26. This force presses the rollers 54 firmly against the individual's back 22.

A reaction force is applied by the rollers 54 against the inner side surfaces 78 of the sockets 72 to urge the front panel 74 toward a rear panel 82 of the dispensing section 26 (FIG. 4). The sockets 72 cooperate with the rollers 54 to hold them in place on the front panel 74.

To promote pressurization of the lotion 46 in the reservoir 44, the connector sections 32 and 34 are aligned with the rear panel 82 (FIG. 4) of the dispensing section 26. The handles 28 and 30 are offset from the rear panel 82 in a direction toward the front panel 74. Tension force transmitted from the handles 28 and 30 through the connector sections 32 and 34 urges the rear panel 82 toward the front panel 74 and the individual's back 22. This results in the lotion 46 being squeezed between the front panel 74 and rear panel 82. It is contemplated that another mechanism, such as hand-operated pump with check valves, could be attached to the apparatus 20 and used to pressurize the lotion 26 in the reservoir 44.

As the lotion 46 is conducted at a controlled rate from the reservoir 44 by the rollers 54, the volume of the lotion in the reservoir decreases. As the volume of lotion in the reservoir decreases, the distance between the front and rear panels 74 and 82 decreases in the manner illustrated schematically in FIG. 5. Therefore, as lotion 46 is dispensed from the reservoir 44 and applied to the individual's back 22, the size of the reservoir 44 decreases while the lotion is pressurized in the reservoir.

By pressurizing the lotion 46 in the reservoir 44 as the volume of lotion in the reservoir decreases during use of the lotion application apparatus 20, a substantially uniform rate of application of lotion to the individual's back 22 is maintained. The uniform application of lotion to the individual's back 22 is promoted by the fact that all of the rollers 54 are exposed to the lotion 46 in the reservoir 44 even though the volume of the lotion in the reservoir is decreasing. In addition, the fluid pressure in the reservoir is maintained substantially constant so that the thickness of a film of lotion applied by the rollers 54 to the skin on the back 22 of the individual remains substantially constant during use of the lotion application apparatus 20.

Figure 2:
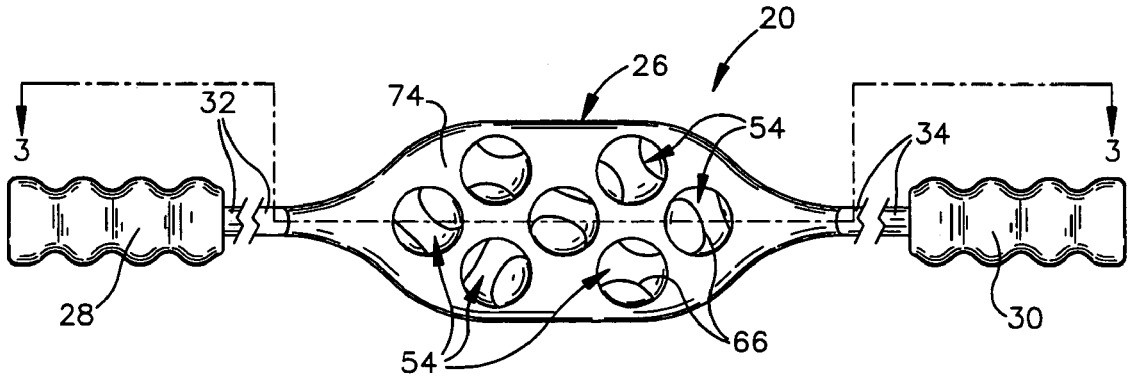
FIG. 2 is a enlarged fragmentary plan view of the lotion application apparatus of FIG. 1 and illustrating a plurality of rollers disposed on a front panel of a dispensing section of the lotion application apparatus.
Figure 3:
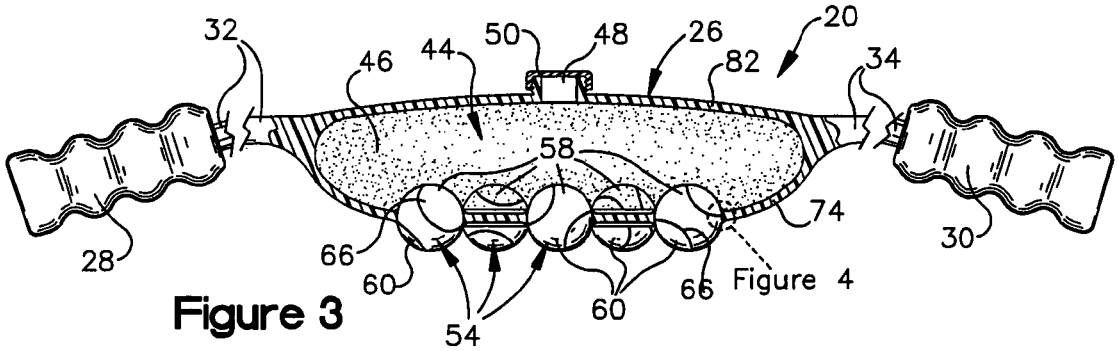
FIG. 3 is a fragmentary sectional view, taken generally along the line 3—3 of FIG. 2, illustrating the manner in which the rollers on the front panel are exposed to lotion in a reservoir in the dispensing section of the lotion application apparatus.

The connector sections 32 and 34 and the front and rear panels 74 and 82 of the dispenser section 26 are integrally molded as one piece of polymeric material. The connector sections 32 and 34 extend in opposite directions from the dispensing section 26 (FIGS. 2 and 3). The connector sections 32 and 34 are flexible so that they can bend under the influence of force applied to the handles 28 and 30. Although the connector sections 32 and 34 and the front panel 74 of the lotion application apparatus 20 are flexible, they have sufficient rigidity to maintain the configuration illustrated in FIG. 3 in absence of the application of force to the handles 28 and 30.

It is contemplated that the connector sections 32 and 34 may be formed separately from the dispensing section 26 of the lotion application apparatus 20. If this is done, the connector sections 32 and 34 would be connected to the left and right (as viewed in FIG. 2) end portions of the dispensing section 26 by suitable connectors.

In the embodiment of the invention illustrated in FIGS. 2–5, rollers 54 are provided at outlets from the dispensing section 26. However, it is contemplated that other known devices may be provided at outlets from the dispensing section to control the flow of lotion from the reservoir 44. For example, valves may be provided on this front panel 74 to control the flow of lotion 46 from the reservoir 44. These valves may be actuated by engagement with the individual's back 22.

In the embodiment of the lotion application apparatus 20 illustrated in FIGS. 1–5, the connector sections 32 and 34 and the front and rear panels 74 and 82 of the lotion application apparatus 20 are integrally molded of a suitable polymeric material. However, it is contemplated that the connector sections 32 and 34 and the front and rear panels may be formed of different materials if desired. For example, the connector sections 32 and 34 may be formed of rope which is connected with the dispensing section 26. It is believed that it will be desired to have the connections between the pieces of rope forming the connector sections 32 and 34 and the dispensing section 26 be in alignment with the rear panel 82 to facilitate pressurizing of lotion 46 in the reservoir 44. Alternatively, the connector sections 32 and 34 may be formed of a woven fabric. It is contemplated that the connector sections 32 and 34 may be formed of any desired material.

Figure 5:
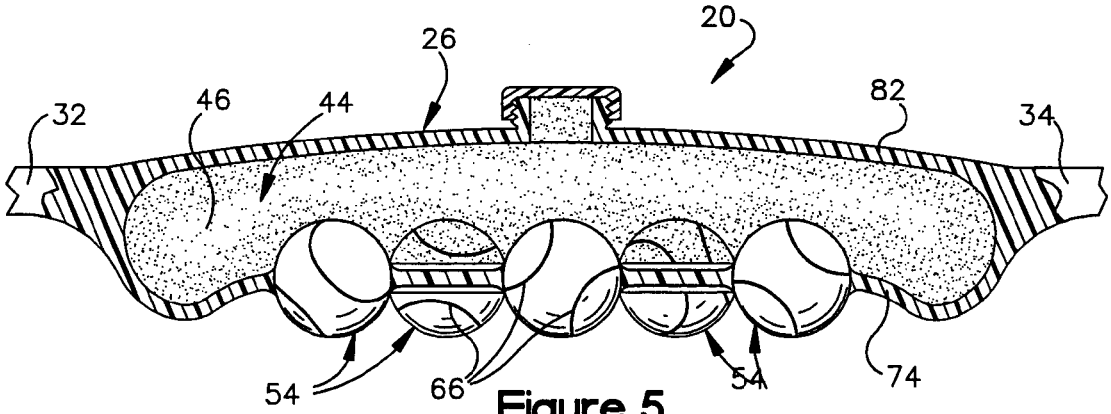
FIG. 5 is a schematic fragmentary sectional view, generally similar to FIG. 3, depicting the manner in which the front panel and rollers of the dispensing section are movable toward a rear panel of the dispensing section as lotion is applied to an individual.

Although the front panel 74 is flexible so that it can deform from the initial or extended condition of FIG. 4 to the retracted condition FIG. 5 under the influence of force transmitted from the handles 28 and 30, the front panel has sufficient rigidity to form the sockets 72 (FIG. 4) to hold the rollers 54. The sockets 72 are formed by relatively thick annular rims which extend around circular openings in which the spherical rollers 54 are disposed.

In the embodiment of the invention illustrated in FIGS. 1–5, the lotion is applied at ambient temperature. However, it is contemplated that it may be desired to apply the lotion at a temperature which is above ambient temperature. In the embodiment of the invention illustrated in FIG. 6, the lotion is heated before being applied. Since the embodiment of the invention illustrated in FIG. 6 is generally similar to the embodiment of the invention illustrated in FIGS. 1–5, similar numerals will be utilized to identify similar components, the suffix letter "a" being associated with the numerals of FIG. 6 to avoid confusion.

A lotion application apparatus 20*a* includes a dispenser section 26*a* to which handles (not shown) are connected by connector sections 32*a* and 34*a*. The dispenser section 26*a* includes a reservoir 44*a* in which lotion 46*a* is disposed. Spherical rollers 54*a* are rotatably mounted in sockets in a front panel or wall 74*a*.

The connector sections 32*a* and 34*a* are aligned with a rear panel 82*a*. This enables force to be transmitted between an individual's body and the connector sections to pressurize the lotion 46*a* in the reservoir 44*a* in the manner previously explained in conjunction with the embodiment of the invention illustrated in FIGS. 1–5.

Figure 6:
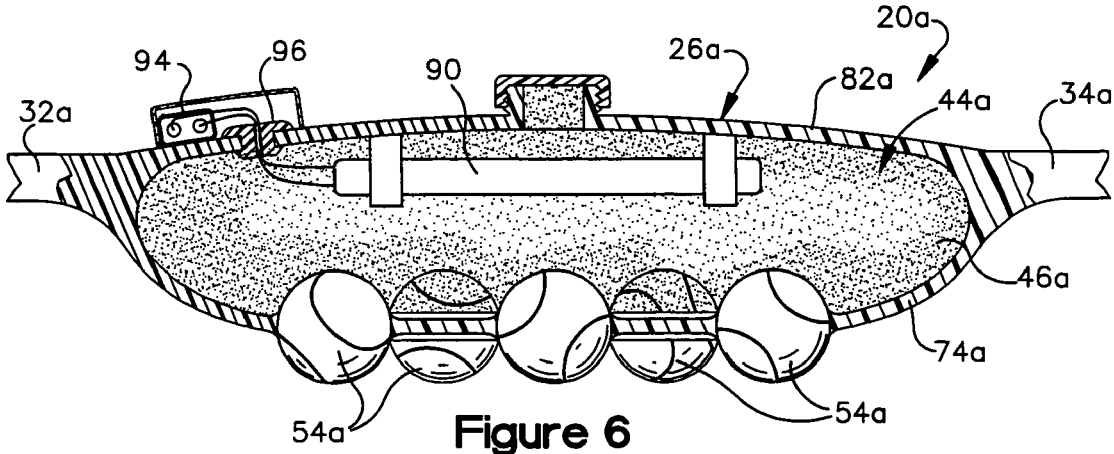
FIG. 6 is a fragmentary sectional view, generally similar to FIG. 5, illustrating an embodiment of the lotion application apparatus having a heater in the reservoir.

In accordance with a feature of the embodiment of the invention illustrated in FIG. 6, a heater 90 is disposed in the reservoir 44*a*. The heater 90 is energized by a battery 94. The battery 94 is connected with the heater 90 by conductors which extend through a grommet 96 mounted in the rear panel 82*a* of the dispenser section 26*a*.

Shortly before the lotion application apparatus 20*a* is to be utilized, a switch (not shown) is actuated to complete a circuit to effect energization of the heater 90 by the battery 94. The heater 90 is then effective to heat the lotion 46*a* in the reservoir 44*a*. The battery 94 may maintain the heater 90 energized during use of the lotion application apparatus 20*a*.

Rather than utilizing a battery 94 to energize the heater 90, it is contemplated that the heater may be connected with an external source of power. This may be done through a transformer or through an electrical conductor connected with an external power supply. A thermostat may be provided in association with the heater 90 to limit the temperature to which the lotion 46*a* is heated.

In the embodiments of the invention illustrated in FIGS. 1–6, the lotion 46*a* is applied to the individual's body by rollers 54. In the embodiment of the invention illustrated in FIG. 7, the lotion is applied to an individual's body by rollers and by injectors. Since the embodiment of the invention illustrated in FIG. 7 is generally similar to the embodiments of the invention illustrated in FIGS. 1–6, similar numerals will be utilized to designate similar components, the suffix letter "b" being associated with the numerals of FIG. 7 to avoid confusion.

A lotion application apparatus 20*b* includes a dispenser section 26*b* which is connected with handles (not shown) by connector sections 32*b* and 34*b*. The connector sections 32*b* and 34*b* are connected with opposite ends of the dispenser section 26*b*.

The dispenser section 26*b* includes a reservoir 44*b* which holds the lotion 46*b*. A plurality of spherical rollers 54*b* are rotatably mounted on a front panel 74*b* of the dispenser section 26*b*. The front panel 74*b* of the dispenser section 26*b* is movable toward a rear panel 82*b* of the dispenser section 26*b* to pressurize the lotion 46*b* in the reservoir 44*b* in the manner previously explained in conjunction with the embodiments of the invention illustrated in FIGS. 1–6.

Figure 7:
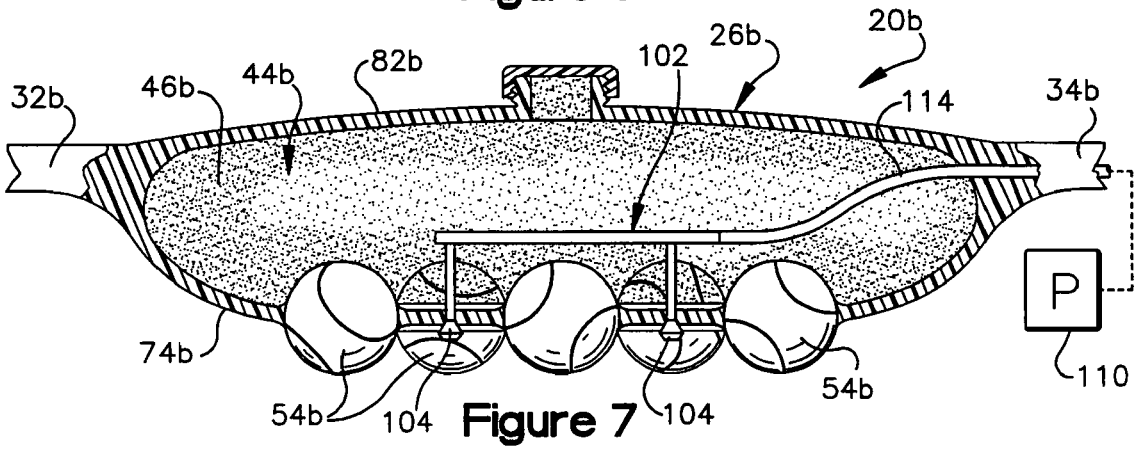
FIG. 7 is a fragmentary sectional view, generally similar to FIG. 5, illustrating an embodiment of the lotion application apparatus having an injector with outlets to dispense lotion.

In accordance with a feature of the embodiment of the invention illustrated in FIG. 7, an injector assembly 102 is provide to direct the flow of lotion onto the individual's body, at locations between the rollers 54*b*. The injector assembly 102 includes a plurality of outlets 104 which are connected with the front panel 74*b* of the dispensing section 26*b*. The outlets 104 are connected in fluid communication with a pump 110 through conduits 114.

The pump 110 is manually actuatable to cause lotion 46*b* to flow from the pump through the conduit 114 to the injector outlets 104. A flow of lotion 46*b* from the injector outlet 104 is applied to the individual's body at locations between the rollers 54*b*. Since the injector outlets 104 are located between the rollers 54*b*, the rollers are effective to distribute the lotion from the injector outlets 104 over the individual's body.

The pump 110 may include a flexible container which holds a supply of the lotion 46*b*. The flexible container forming the pump 110 is manually squeezed to cause the lotion to flow from the pump through the conduit 114 to the injector outlets 104.

If desired, the pump 110 may be disposed on the connector section 34*b* adjacent to a handle corresponding to the handle 30 of FIGS. 2 and 3. If this is done, a thumb on a hand of the individual 24 using the lotion application apparatus may be used to pressurize the flexible container holding a supply of the lotion 46*b* and forming the pump. Alternatively, the pump 110 may be activated by a source of power. Of course, the pump 110 may be disposed at a location other than adjacent to a handle of the lotion application apparatus 20*b*.

Figure 8:
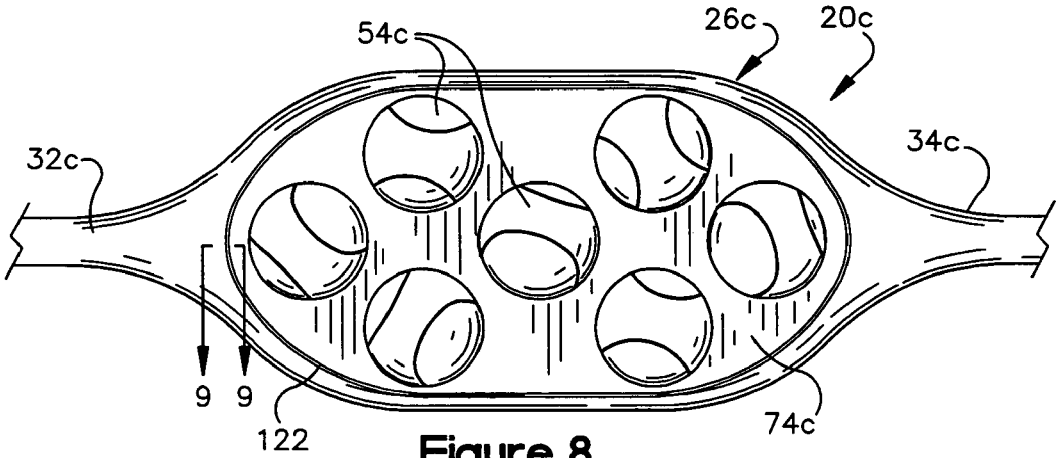
FIG. 8 is a fragmentary plan view, generally similar to FIG. 2, illustrating an embodiment of the lotion application apparatus having a hinge which facilitates movement of rollers on a front panel of the dispensing apparatus toward a back panel of the dispensing apparatus.
Figure 9:
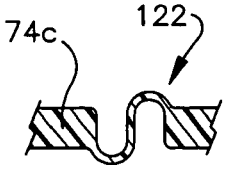
FIG. 9 is an enlarged fragmentary sectional view of a portion of FIG. 8 and illustrating the construction of the hinge.

In the embodiments of the invention illustrated in FIGS. 1–7, the front panel 74 of the dispenser section 26 is resiliently flexed in the manner indicated schematically in FIG. 5 to pressurize the lotion 46 in the reservoir 44. To facilitate the pressurizing of the lotion in the reservoir, the embodiment of the invention illustrated in FIGS. 8 and 9 includes a hinge which connects the front panel of the dispenser section with the remainder of dispenser section. Since the embodiment of the invention illustrated in FIGS. 8 and 9 is generally similar to the embodiments of the invention in FIGS. 1–7, similar numerals will be utilized to identify similar components, the suffix letter "c" being associated with the embodiments of FIGS. 8 and 9.

A lotion application apparatus 20*c* includes a dispenser section 26*c* which is connected with handles (not shown) by connector sections 32*c* and 34*c*. A plurality of rollers 54*c* are rotatably mounted in a front panel 74*c* of the dispenser section 26*c*.

In accordance with a feature of this embodiment of the invention, a hinge 122 (FIGS. 8 and 9) connects the front panel 74*c* with a remainder of the dispenser section 26*c*. The hinge 122 is resiliently flexible to enable the front panel 74*c* to move toward a rear panel of the dispenser section 26*c* in a manner similar to that illustrated schematically in FIG. 5. The hinge 122 is readily deflectable to enable the front panel 74*c* to move toward the rear panel (not shown) of the dispenser section 26*c*. This facilitates pressurizing of the lotion in the reservoir of the dispenser section 26*c* during use of the lotion application apparatus 20*c* in the manner previously explained in conjunction with the embodiments of the invention illustrated in FIGS. 1–7.

In the embodiments of the invention illustrated in FIGS. 1–9, the rollers 54 are rotatably mounted in sockets formed in the front panel 74 of the lotion application apparatus 20 in the manner illustrated in FIG. 4. In the embodiment of the invention illustrated in FIG. 10, the rollers are mounted in preformed sockets which are connected with the front panel of the dispenser section. Since the embodiment of the invention illustrated in FIG. 10 is generally similar to the embodiments of the invention illustrated in FIGS. 1–9, similar numerals will be utilized to designate similar components, the suffix letter "d" being associated with the numerals of FIG. 10 to avoid confusion.

A lotion application apparatus 20*d* includes a dispensing section 26*d* which is connected with handles (not shown) corresponding to handles 28 and 30 of FIGS. 2 and 3, by connector sections corresponding to the connector sections 32 and 34. The dispensing section 26*d* includes a front panel 74*d* in which rollers 54*d* are rotatably mounted.

Figure 10:
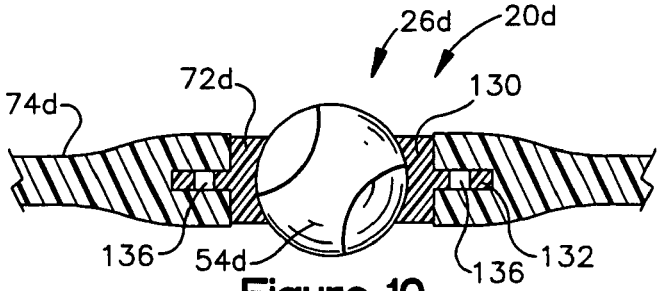
FIG. 10 is an enlarged fragmentary sectional view illustrating an embodiment of the lotion application apparatus in which a roller is mounted in a socket connected with the dispensing section.

In accordance with a feature of the embodiment of the invention illustrated in FIG. 10, the rollers 54*d* are mounted in sockets 72*d* which are formed separately from the front panel 74*d*. Each of the sockets 74*d* includes an annular sidewall 130. An annular flange 132 extends radially outward from the annular sidewall 130 and is connected with the front panel 74*d* of the dispensing section 26*d*.

To facilitate connection of the socket flange 132 with the front panel 74*d* of the dispensing section 26*d*, a plurality of openings 136 are formed in the flange. The polymeric material forming the dispensing section 26*d* is molded around the sidewall 130 of the preformed socket 72*d* and enters the opening 136 to interconnect the socket sidewall 130 and the front panel 74*d*. It should be understood that the sockets 72*d* may be connected with the dispensing section 26*d* in a different manner if desired.

In the embodiments of the invention illustrated in FIGS. 1–10, the lotion application apparatus 20 is used to apply lotion to an individual's body. However, it is contemplated that the lotion application apparatus can be utilized to perform other functions in addition to the application of lotion to an individual's body. In the embodiment of the invention illustrated in FIG. 11, the lotion application apparatus is adapted to scratch the individual's back. Since the embodiment of the invention illustrated in FIG. 11 is generally similar to the embodiments of the invention illustrated in FIGS. 1–10, similar numerals will be utilized to identify similar components, the suffix letter "e" being associated with the numerals of FIG. 11 to avoid confusion.

A lotion application apparatus 20*e* includes a dispenser section 26*e* to which handles (not shown) are connected by connector sections 32*e* and 34*e*. The dispenser section 26*e* includes a reservoir 44*e* in which lotion 46*e* is disposed. Spherical rollers 54*e* are rotatably mounted in sockets in a front panel or wall 74*e*.

The connector sections 32*e* and 34*e* are aligned with a rear panel 82*e*. This enables force to be transmitted between the individual's body and the connector sections 32*e* and 34*e*. This force is effective to pressurize the lotion 46*e* in the reservoir 44*e* in the manner previously explained in conjunction with the embodiment of the invention illustrated in FIGS. 1–5.

Figure 11:
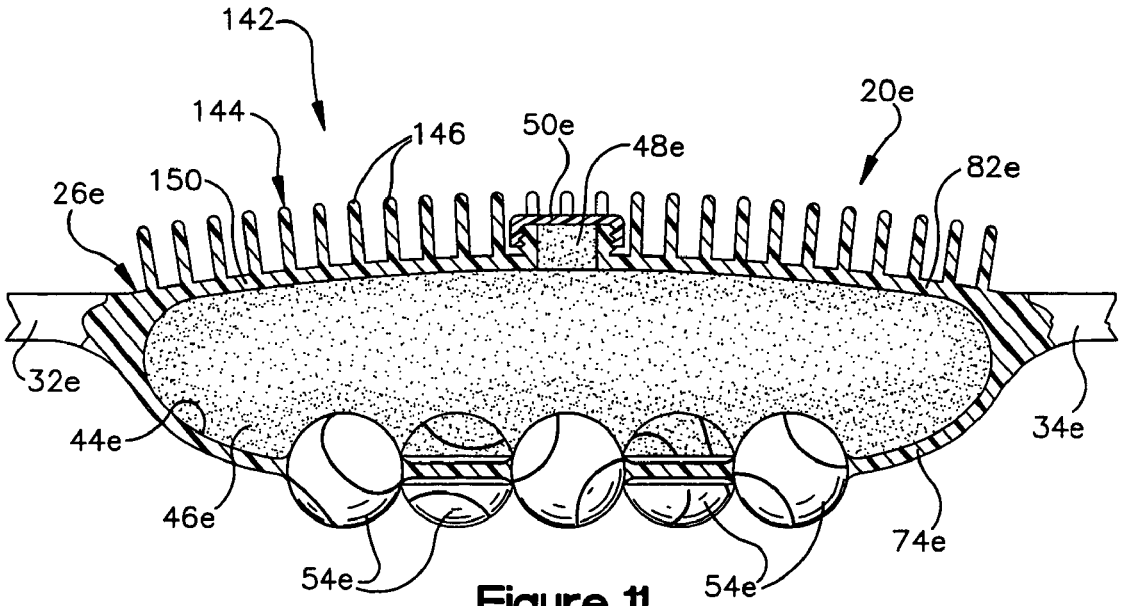
FIG. 11 is a schematic fragmentary sectional view, generally similar to FIG. 5, illustrating an embodiment of the lotion application apparatus which includes a back scratcher.

In accordance with a feature of the embodiment of the invention illustrated in FIG. 11, a back scratcher 142 is mounted on the rear panel 82*e*. The back scratcher 142 includes an array 144 of flexible teeth 146. The array 144 of teeth 146 is coextensive with the rear panel 82*e*. However, there is an opening in the array 144 of teeth 146 to provide access to a cover 50*e* over the inlet 48*e* to the reservoir 44*e*.

The back scratcher 142 includes a base 150 which is formed by the rear panel 82*e*. The teeth 146 are integrally formed as one piece with the base 150. The teeth 146 and base 150 may be formed of a suitable polymeric material. If desired, the base 150 and/or teeth 146 may be formed separately from each other and/or from the rear panel 82*e*.

When the lotion application apparatus 20*e* is to be utilized to scratch an individual's back, the handles connected with the dispensing section 26*e* of the lotion application apparatus 20*e* are manually gripped and the back scratcher 142 is pressed against the back of the individual using the lotion application apparatus 20*e* to scratch his or her back. Thus, the dispensing section 26*e* would be offset by 180 degrees from the orientation illustrated in FIG. 1 in association with the lotion application apparatus 20. This would result in the back panel 82*e* and the back scratcher 142 of the lotion application apparatus 20*e* (FIG. 11) facing toward the individual's back. The handles connected with the dispensing section 26*e* would then be reciprocated back and forth to move the scratch backer 142 between opposite sides of the individual's back. As this is done, the handles would be moved up and down to move the back scratcher 142 up and down along the individual's back.

Although the back scratcher 142 has been illustrated in FIG. 11 in association with the embodiment of the invention illustrated in FIGS. 1–5, it should be understood that the back scratcher 142 may be associated with any one of the embodiments of the invention previously described herein.

In the embodiments of the invention illustrated in FIGS. 1–5, the lotion 46 in the reservoir 44 is pressurized by pressing the rollers 54 against an individual's back under the influence of force transmitted from the handles 28 and 30. In the embodiment of the invention illustrated in FIG. 12, lotion in a dispensing section of the lotion application apparatus is pressurized by manually actuating a pump to inflate a bladder disposed in a reservoir which holds the lotion. Since the embodiment of the invention illustrated in FIG. 12 is generally similar to the embodiments of the invention illustrated in FIGS. 1–11, similar numerals will be utilized to identify similar components, the suffix letter "f" being associated with the numerals of FIG. 12 to avoid confusion.

A lotion application apparatus 20*f* includes a dispenser section 26*f* (FIG. 12) to which handles (not shown) are connected by connector sections 32*f* and 34*f*. The dispenser section 26*f* includes a reservoir 44*f* in which lotion 46*f* is disposed. Spherical rollers 54*f* are rotatably mounted in sockets in a front panel or wall 74*f*.

The connector sections 32*f* and 34*f* are aligned with a rear panel 82*f*. This enables force to be transmitted between an individual's body and the connector sections 32*f* and 34*f*. This force is effective to pressurize the lotion 46*f* in the reservoir 44*f* in the manner previously described in conjunction with the embodiment of the invention illustrated in FIGS. 1–5.

Figure 12:
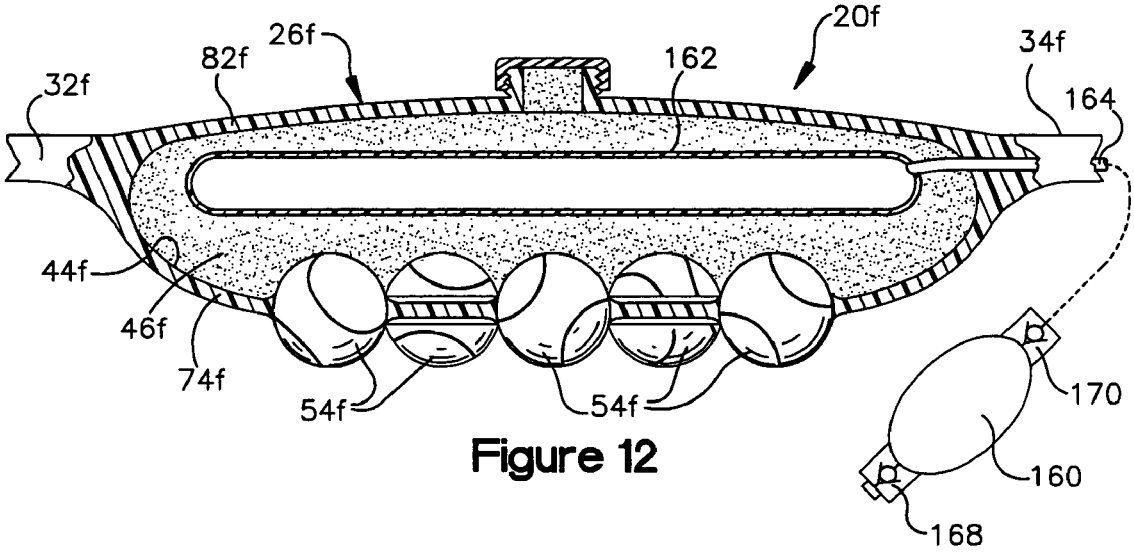
FIG. 12 is a schematic fragmentary sectional view, generally similar to FIG. 5, illustrating an embodiment of the lotion application apparatus having a resiliently expandable bladder in the reservoir.

In accordance with a feature of the embodiment of the invention illustrated in FIG. 12, a pump 160 is manually actuatable to pressurize fluid (air) in a bladder 162 disposed in the reservoir 44*f*. Air under pressure is connected through a conduit 164 to the bladder 162. The bladder 162 is formed of a resiliently deflectable material which is expanded under the influence of pressure in the bladder. Expansion of the bladder 162 results in pressurization of the lotion 46*f* in the reservoir 44*f*.

The pump 160 is formed of a resiliently deflectable material. Air enters a variable volume chamber in the pump 160 through a check valve 168. Air leaves the chamber of the pump 160 through a second check valve 170. Air pressure conducted from the pump 160 is effective to maintain the bladder 162 in an expanded condition to maintain pressure on the lotion 46*f* in the reservoir 44*f*.

When the pump is manually actuated, by squeezing the pump, there is a flow of air from the chamber in the pump through the check valve 170 into the bladder 162. When the pump 160 is manually released, the resilience of the material forming the pump results in expansion of the chamber in the pump. As this occurs, air flows from the atmosphere through the check valve 168 into the expanding pump chamber. The check valve 170 is effective to prevent a back flow of air from the bladder 162 to the pump 160. A manually actuatable valve (not shown) is connected to the conduit 164 to enable fluid pressure to be exhausted from the bladder 162.

In the embodiment of the invention illustrated in FIG. 12, the lotion 46*f* is pressurized by having the pump 160 pressurize air in the bladder 162. However, it is contemplated that the lotion 46*f* may be pressurized in a different manner if desired. For example, the pump 160 may be connected with a supply of lotion and operated to cause lotion to flow into the reservoir 44*f* without having a bladder, corresponding to the bladder 162, in the reservoir. Alternatively, the pump 160 may be operated to cause air under pressure to flow into the reservoir 44*f* without having a bladder, corresponding to the bladder 162, in the reservoir 44*f*.

Figure 13:
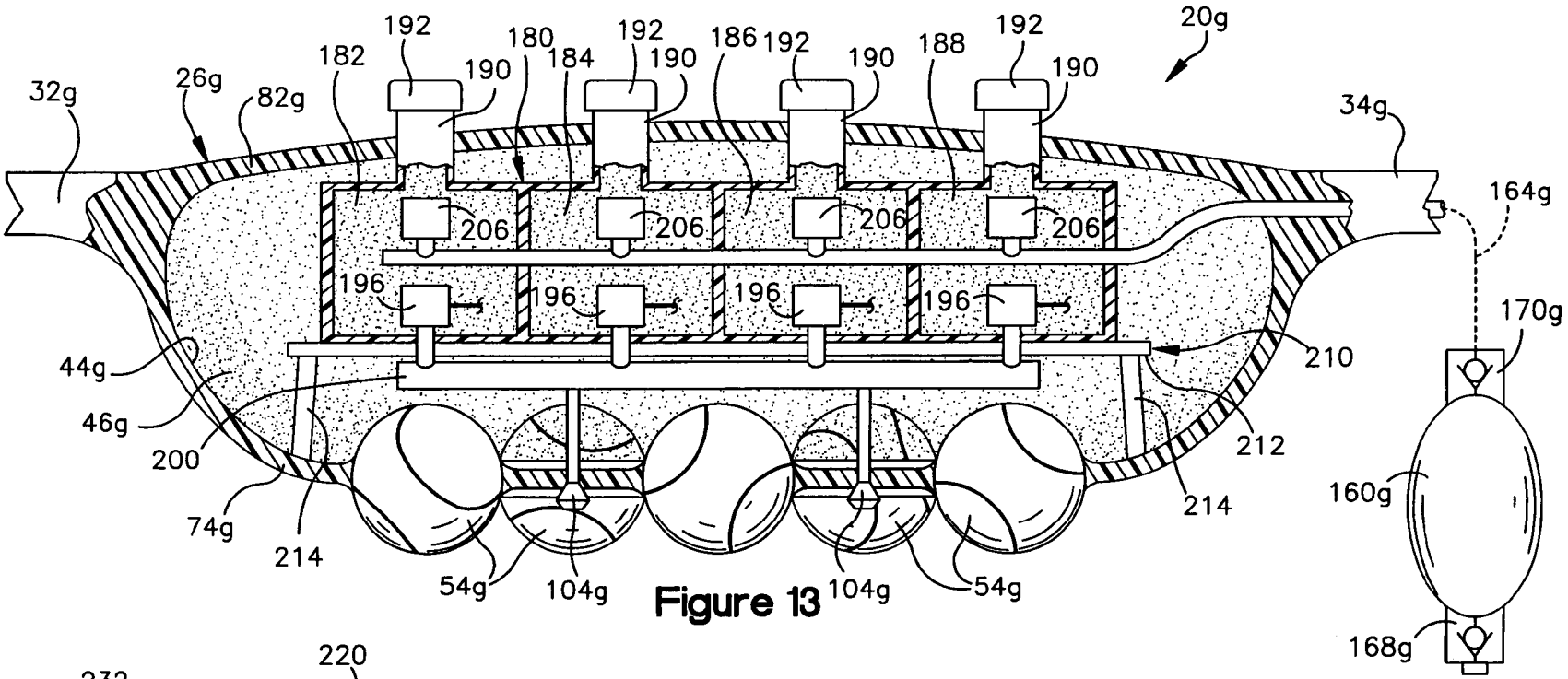
FIG. 13 is a schematic fragmentary sectional view, generally similar to FIG. 5, illustrating an embodiment of the lotion application apparatus having a plurality of compartments in the reservoir.
Figure 14:
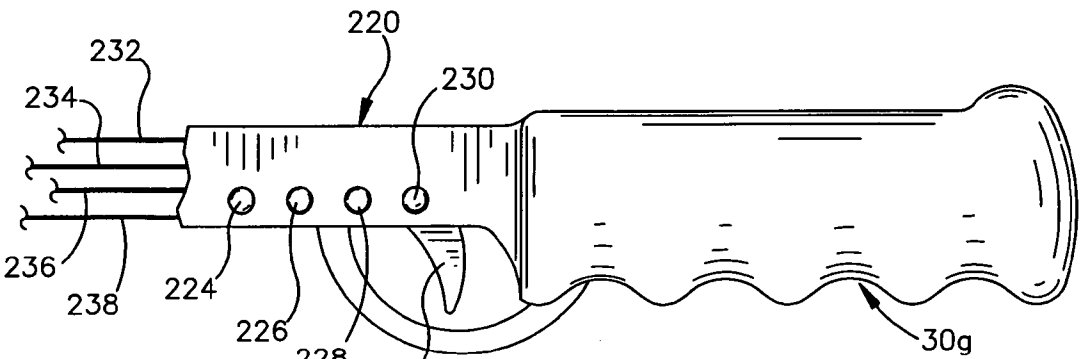
FIG. 14 is a schematic fragmentary illustration of control apparatus connected with the lotion application apparatus of FIG. 13.

In the embodiment of the invention illustrated in FIGS. 13 and 14, any one of a plurality of different lotions may be applied to an individual's back. Since the embodiment of the invention illustrated in FIGS. 13 and 14 is generally similar to the embodiments of the invention illustrated in FIGS. 1–12, similar numerals will be utilized to designate similar components, the suffix letter "g" being associated with the numerals of FIGS. 13 and 14 to avoid confusion.

A lotion application apparatus 20*g* (FIG. 13) includes a dispenser section 26*g* to which handles (not shown) are connected by connector sections 32*g* and 34*g*. The dispenser section 26*g* includes a reservoir 44*g* in which lotion 46*g* is disposed. Spherical rollers 54*g* are rotatably mounted in sockets in a front panel or wall 74*g*.

The connector sections 32*g* and 34*g* are aligned with a rear panel 82*g*. This enables force to be transmitted between the individual's body and the connector sections 32*g* and 34*g* to pressurize the lotion 46*g* in the reservoir 44*g* in the manner previously explained with the embodiment of the invention illustrated in FIGS. 1–5.

In accordance with a feature of the embodiment of the invention illustrated in FIG. 13, an array 180 of compartments is disposed in the reservoir 44*g*. The array 180 of compartments includes separate compartments 182, 184, 186 and 188. Each of the compartments 182–188 has an inlet 190 which is closed by a cover 192. By providing each compartment 182–188 with a separate inlet 190, each compartment may be filled with a different lotion. A separate inlet (not shown) is provided to enable lotion to be conducted to the reservoir 44*g* in the same manner as previously described in conjunction with the inlet 48 of FIG. 3.

Each of the compartments 182–188 has an electrically operated outlet valve 196 which is connected in fluid communication with the inside of the compartment. The outlet valves 196 for the compartments 182–188 are also connected in fluid communication with a manifold 200. The manifold 200 is connected with a plurality of injectors having outlets 104*g*. The injector outlets 104*g* are connected in fluid communication with the manifold 200.

By operating an outlet valve 196 connected with one of the compartments 182–188 holding a desired lotion, the lotion flows from the compartment through the outlet valve to the manifold 200. The lotion then flows from the manifold 200 through the injector outlets 104*g* onto the back or other portion of the body of an individual using the lotion application apparatus 20*g*. At the same time, lotion 46*g* from the reservoir 44*g* is applied to the back of the individual using the lotion application apparatus 26*g* by the rollers 54*g*.

The lotion from the selected one of the compartments 182–188 may be the same as the lotion 46*g*. Alternatively, the lotion from the selected one of the compartments 182–188 may be different than the lotion 46*g*. Assuming that the lotion in one of the compartments, for example the compartment 182, is the same as the lotion 46*g*, the lotion in the other three compartments, that is the compartments 184, 186, and 188 would be different than the lotion 46*g*. Of course, all of the compartments 182–188 may contain lotion which is different than the lotion 46*g*. It is contemplated that a mixture of the lotion from two or more of the compartments 182–188 may be conducted from the manifold 200 through the injector outlets 104 by operating two or more of the outlet valves 196 to the open condition.

A pump 160*g* is connected with each of the compartments 182–188 through check valves 206. The pump 160*g* is also provided with an air inlet check valve 168*g* and an air outlet check valve 170*g*. When the pump 160*g* is manually actuated, fluid (air) flows through a conduit 164*g* to the check valves 206 for each of the compartments 182–188. The air flows through the check valves into the compartments 182–188 to pressurize the lotion in the compartments. The check valves 206 block the flow of air from the compartments back to the conduit 164*g*.

The pressure in the compartments 182–188 may be reduced by opening the covers 192. Alternatively, manually operable exhaust valves may be connected with each of the compartments 182–188. A manually operable exhaust valve is connected with the conduit 164*g* to enable the pressure in the conduit and the pump 160*g* to be reduced to atmosphere pressure.

A platform 210 is provided to support the compartments 182–188 in the reservoir 44*g*. The platform 210 has a main section 212 which is disposed beneath the compartments 182–188. The main section 212 of the platform 210 is disposed on a side of the array 180 of compartments toward the front panel 74*g* of the dispensing section 26*g*. A plurality of legs 214 extend from the main section 212 of the platform 210 to the front panel 74*g* to provide support for the main section and the array 180 of compartments.

The compartments 182–188 are interconnected to form a unitary structure. Thus, the compartments 182–188 have common walls which define chambers in the compartments. However, if desired, each of the compartments 182–188 may be formed separately from the other compartments. The separate compartments may be interconnected by suitable fasteners.

The array 180 of compartments has a rectangular configuration. Each of the compartments 182–188 has a rectangular configuration. However, it is contemplated that the array 180 of compartments may have a configuration other than the illustrated rectangular configuration. Similarly, each of the compartments 182–188 may have a configuration other than the illustrated rectangular configuration.

It is believed that it may be desired to support the array 180 of compartments by connecting the array with the rear wall 82*g*. This may be done by extending the legs 214 only in an upward direction (as viewed in FIG. 13) from the main section 212 and connecting them to the rear wall 82*g*. Alternatively, retainers may be provided to secure the cylindrical outlets 190 to the rear wall 82*g*. For example, after the cover 192 has been removed, a sealing washer may be moved axially along the inlet 190 and a nut screwed onto an external thread convolution formed on the outside of the inlet 190. Alternatively, the compartments 182–188 may be integrally formed as one piece with the rear wall 82*g*.

A control apparatus 220 (FIG. 14) is provided in association with a handle 30*g* which is connected with the dispensing section 26*g* (FIG. 13) by the connector sections 34*g*. The control apparatus 220 includes a plurality of buttons 224, 226, 228, and 230 which are connected with the outlet valves 196 by leads 232, 234, 236, and 238. The lead 232 is connected with the button 224 and the control valve 196 for the compartment 182. Similarly, the lead 234 and button 226 is connected with the control valve 196 for the compartment 184. The lead 236 and control button 228 are connected with the outlet valve 196 for the compartment 186. The lead 238 and control button 230 are connected with the outlet valve 196 for the compartment 188.

By actuating at least one of the buttons 224–230 lotion from an associated one of the compartments 182–188 may be selected for distribution to the manifold 200 and injector outlets 104*g*. For example, by manually depressing the button 226, the compartment 184 is selected. An actuator or trigger 236 is provided adjacent to the handle 30*g*. By manually actuating the trigger 236 a circuit for energizing a selected outlet valve is completed. The control apparatus 220 includes a suitable battery (not shown) to provide power to operate the selected outlet valve 196.

For example, when the button 226 is manually depressed and the trigger 236 is actuated, the outlet valve 196 connected with the compartment 184 is operated from a closed condition to an open condition. This enables lotion to flow from the compartment 184 through the outlet valve 196 to the manifold 200 and the injector outlets 104*g*. Of course, lotion from one or more compartments 182–188 may be conducted to the manifold 200*g* by actuating the associated control buttons 224–230 and then manually operating the trigger 236.

If desired, the pump 160*g* (FIG. 13) may be included in a handle 30*g* (FIG. 14). If the pump 160*g* is included in the handle 30*g*, it would merely be necessary for an individual utilizing the lotion application apparatus 20 to manually squeeze the handle to operate the pump.

The control apparatus 220 should be considered as being exemplary of many different types of control apparatus which may be utilized to control the operation of the outlet valves for the compartments 182–188. For example, slide switches may be provided on the connector sections 32*g* and/or 34*g* rather than the push buttons 224–230. Alternatively, the control buttons 224–230 may be mounted on the rear wall 82*g* of the dispenser section 26*g*. If desired, rather than utilizing electrically actuated outlet valves, mechanical linkages may be constructed with actuator members extending through the rear wall 82*g* of the dispenser section 26*g*.

In view of the foregoing description, it is apparent that the present invention provides a new and improved lotion application apparatus 20 for applying lotion to portions of an individual's body. The apparatus 20 includes a pair of handles 28 and 30 which are connected with end portions of a lotion dispensing section 26. The lotion dispensing section 26 includes a reservoir 44 to hold lotion 46 and a plurality of rollers 54. Each of the rollers 54 has an inner portion 58 exposed to the lotion 46 in the reservoir 44 and an outer portion 60 which is engageable with the individual using the apparatus 20. The handles 28 and 30 are movable by the individual using the apparatus to roll the rollers 54 along the individual's skin.

The present invention includes a plurality of different features. These features may be used separately or in combination with each other. Features of the prior art may be used in combination with one or more of the features of the present invention.

Having described the invention, the following is claimed:

1. An apparatus for use in applying lotion to at least a portion of a body of an individual using the apparatus, said apparatus comprising:

a lotion dispensing section;

a first handle connected with a first end portion of said lotion dispensing section; and a second handle connected with a second end portion of said lotion dispensing section;

said lotion dispensing section including a reservoir to hold lotion and a plurality of rollers which are rotatable relative to said lotion dispensing section, each of said rollers having an inner portion exposed to the lotion in said reservoir and an outer portion which is engageable with the body of the individual using the apparatus, said reservoir being compressible to allow lotion dispensing regardless of orientation;

said first and second handles being manually movable by the individual using said apparatus to roll said rollers along the body of the individual.

2. An apparatus as set forth in claim 1 wherein each of said rollers has a spherical configuration and is disposed in a socket connected with said lotion dispensing section.

3. An apparatus as set forth in claim 1 further including a groove formed in each of said rollers to conduct lotion from said reservoir during rolling of said rollers along the body of the individual.

4. An apparatus as set forth in claim 1 wherein each of said rollers is disposed in a socket having a surface which cooperates with a respective one of said rollers to control the rate of conduction of lotion from the reservoir during rolling of the rollers along the body of the individual.

5. An apparatus as set forth in claim 1 further including a heater disposed in said reservoir to heat the lotion.

6. An apparatus as set forth in claim 1 further including an injector having a plurality of outlets disposed between rollers of said plurality of rollers to dispense lotion.

7. An apparatus as set forth in claim 6 wherein said injector includes a pump which is manually operable to supply lotion under pressure to said outlets.

8. Apparatus as set forth in claim 1 wherein said lotion dispensing section includes a hinge which interconnects a first portion of said dispensing section on which said rollers are disposed and a second portion of said dispensing section, said hinge being deflectable to enable said first portion of said dispensing section to move relative to said second portion of said dispensing section during application of lotion to the body of the individual.

9. An apparatus set forth in claim 1 further including a first connector section extending between said first handle and said first end portion of said lotion dispensing section, and a second connector section extending between said second handle and said second end portion of said lotion dispensing section.

10. An apparatus as set forth in claim 9 wherein said first and second connector sections are integrally formed as one piece with said first and second end portions of said lotion dispensing section.

11. An apparatus as set forth in claim 1 further including a back scratcher connected with said lotion dispensing section, said back scratcher being pressed against the body of the individual using the apparatus under the influence of force applied to said first and second handles by the individual using the apparatus.

12. An apparatus as set forth in claim 1 further including a bladder disposed in said reservoir, and a pump connected in fluid communication with said bladder, said pump being manually operable to induce a flow of fluid into said bladder to expand said bladder.

13. An apparatus as set forth in claim 1 further including a plurality of compartments disposed in said lotion dispensing section to hold lotion, each of said compartments being effective to maintain a body of lotion separate from lotion in the reservoir.

14. An apparatus as set forth in claim 13 further including a plurality of outlet valves connected in fluid communication with said compartments, each of said outlet valves being operable from a closed condition to an open condition to enable lotion to flow from one of said compartments onto the body of the individual using said apparatus.

15. An apparatus as set forth in claim 14 further including a plurality of control elements disposed adjacent to one of said first and second handles and connected with said outlet valves, said control elements being manually operable to effect operation of at least one of said outlet valves between the open and closed conditions.

16. An apparatus for use in applying lotion to at least a portion of a body of an individual using the apparatus, said apparatus comprising:

a lotion dispensing section;

a first handle connected with a first end portion of said lotion dispensing section; and a second handle connected with a second end portion of said lotion dispensing section;

said lotion dispensing section including a reservoir to hold lotion and a plurality of rollers which are rotatable relative to said lotion dispensing section, each of said rollers having an inner portion exposed to the lotion in said reservoir and an outer portion which is engageable with the body of the individual using the apparatus, said lotion dispensing section further including a front panel on which said plurality of rollers are disposed and a rear panel which cooperate to at least partially define said reservoir, said front panel being movable toward said rear panel under the influence of force applied to said rollers during application of lotion to the body of an individual;

said first and second handles being manually movable by the individual using said apparatus to roll said rollers along the body of the individual.

* * * * *